US012540445B2

(12) United States Patent
Bax

(10) Patent No.: US 12,540,445 B2
(45) Date of Patent: Feb. 3, 2026

(54) DEVICE AND METHOD FOR PROCESSING A SURFACE

(71) Applicant: Art En Reno BVBA, Oud-Turnhout (BE)

(72) Inventor: Fanciscus Andreas Anna Maria Bax, Oud-Turnhout (BE)

(73) Assignee: Art En Reno BVBA, Oud-Turnhout (BE)

( * ) Notice: Subject to any disclaimer, the term of this patent is extended or adjusted under 35 U.S.C. 154(b) by 680 days.

(21) Appl. No.: 18/056,971

(22) Filed: Nov. 18, 2022

(65) Prior Publication Data

US 2023/0160157 A1 May 25, 2023

(30) Foreign Application Priority Data

Nov. 19, 2021 (NL) ..... 2029843

(51) Int. Cl.
*E01C 23/088* (2006.01)

(52) U.S. Cl.
CPC ..... *E01C 23/088* (2013.01)

(58) Field of Classification Search
CPC .. E01C 23/088; E01C 23/0885; E01C 23/094; B24B 7/186; B28D 1/20
USPC ..... 404/112
See application file for complete search history.

(56) References Cited

U.S. PATENT DOCUMENTS 2,759,305 A * 8/1956 Helbig ..... A47L 11/4069 D8/62
3,472,555 A * 10/1969 Heinrich ..... E01C 23/0885 299/59
5,409,299 A * 4/1995 Holder ..... B24B 7/186 451/353
6,640,377 B2 * 11/2003 Krause ..... B24D 13/147 15/230

(Continued)

FOREIGN PATENT DOCUMENTS

EP 4114612 B1 * 10/2024 ..... B24D 9/08
GB 2520308 A 5/2015
WO 2019106598 A1 6/2019

OTHER PUBLICATIONS

European Patent Office; Search Report and Written Opinion for corresponding application No. NL2029843, dated Mar. 26, 2022.

*Primary Examiner* — Gary S Hartmann
(74) *Attorney, Agent, or Firm* — McDonnell Boehnen Hulbert & Berghoff LLP

(57) ABSTRACT

Device and corresponding method for processing a hard surfacing. The device comprises a frame to be mounted to a vehicle, a support coupled to the frame, for carrying at least a first rotary processing unit for processing the hard surfacing, and wherein each rotary processing unit comprises a drive motor with a drive shaft, for rotating the rotary processing unit relative to the support; a substantially flat first disc comprising a plurality of processing heads for processing the hard surfacing; a substantially flat second disc coupled via vibration-damping coupling elements to the (Continued)

first disc and extending parallel to the first disc; a substantially flat third disc coupled via one or more deformation-reducing coupling elements to the second disc and extending parallel to the second disc, wherein the first, second and third discs form a stack of discs that is rotatable relative to the support.

22 Claims, 6 Drawing Sheets

(56) References Cited

U.S. PATENT DOCUMENTS

| | | | | |
|---|---|---|---|---|
| 6,786,812 | B2 * | 9/2004 | Stuckenholz | B24D 13/16 451/526 |
| 8,646,847 | B2 | 2/2014 | Cochran et al. | |
| 8,790,164 | B2 * | 7/2014 | Rivard | B24D 9/085 451/538 |
| 8,808,065 | B2 * | 8/2014 | Weder | B24D 9/08 451/529 |
| 9,314,899 | B2 * | 4/2016 | Puchegger | B24B 7/18 |
| 10,449,651 | B2 * | 10/2019 | Stark | B24B 7/186 |
| 2019/0240803 | A1 | 8/2019 | Matson | |
| 2021/0205942 | A1 * | 7/2021 | Tchakarov | B24B 41/0475 |
| 2022/0001515 | A1 * | 1/2022 | Tchakarov | E04F 21/248 |

* cited by examiner

DEVICE AND METHOD FOR PROCESSING A SURFACE

CROSS-REFERENCE TO RELATED APPLICATIONS

The present application is a non-provisional patent application claiming priority to Netherlands Patent Application No. NL 2029843, filed Nov. 19, 2021, the contents of which are incorporated herein by reference.

FIELD OF THE DISCLOSURE

The present disclosure relates to a device and method for processing a hard surfacing, particularly a road surface.

BACKGROUND

There are many types of surface paving, for instance for the purpose of a road, square, pavement and the like. A surface can for instance be paved with an asphalt paving, including asphalt concrete, a concrete paving, including concrete slabs and continuously reinforced concrete roads, and paving elements, including clinkers, concrete paving stones, brick and natural stone. It may sometimes be necessary to process such a paved surfacing, for instance in order to flatten protrusions such as bumps in an asphalt paving, edges of concrete slabs which lie askew, transitions between road surface parts and the like so as to (once again) even out the surface of the surfacing. The surface of a surfacing can be processed in different ways. The surface of a surfacing can be milled, grinded, polished or hammered.

Over the years, machines have been developed with which a road surface can be processed by guiding a number of processing discs over the surfacing. Such machines can consist of a self-propelled, mobile vehicle, for instance a tractor or the like, on which is provided a frame with a number of rotating discs provided with processing heads, like chisels, hammers or grinding elements (plates). The discs are dragged or pushed over the surfacing and extend herein parallel relative to the road surface. While being pushed or dragged along, the discs rotate at a determined speed just above the road surface, so that the processing heads are able to mill, grind, polish or hammer the upper surface thereof.

In a known type of bush hammering machine small wheels with bush hammers are arranged on a rotating stack of two discs. To increase the lifespan of the machine, it is known to used vibration coupling elements between the two discs. In this way high vibration levels generating during the processing, both in the discs and in the drive of the discs are not transmitted to the vehicle and/or to the driver thereof. The rotating stack of discs is then mounted on a vehicle which can travel over the surfacing. When the stack of discs rotates, the hammers come into contact with the surfacing and strike small dents therein. When the vehicle moves (in an (optionally linear) direction of travel ($P_1$)) during rotation of the two or more discs, a strip of processed surfacing can thus be obtained.

A drawback of the known machine is that it has a short lifespan, or in any case requires frequent repairs and/or maintenance. The size of the surface of the surfacing which can be treated will in practice be limited (characteristically several hundred square metres) before more repairs or maintenance have to be performed on the machine.

Rather high deformation forces are exerted during the processing with the known machine on the surface of the discs. Due to these deformations, the flatness of the discs may be affected, which results in damage or excessive wear of the vehicle.

A further drawback of the known devices with two discs and vibration damping coupling elements in between is that the final result of the processing treatment is sometimes insufficient, for instance because certain unevenness in the surfacing, particularly the larger bumps in the surfacing, can be smoothed out insufficiently well by the deformed discs.

SUMMARY

It is an object of the present disclosure to provide an improved device and method for processing a surfacing, wherein at least one of the above stated drawbacks is at least partially obviated.

It is also an object of the disclosure to provide a device and method with which a surfacing can be flattened in accurate manner without the equipment used herein being impacted too much.

It is a further object of the disclosure to provide a device and method wherein a high degree of surface-tracking flatness can be realized.

According to a first aspect of the disclosure, a device is for this purpose provided for processing a hard surfacing, the device comprising a frame to be mounted to a vehicle and a support coupled to the frame, for carrying at least a first rotary processing unit. Each rotary processing unit is adapted for processing the hard surfacing under the processing unit and each rotary processing unit comprises a drive motor with a drive shaft, for rotating the rotary processing unit relative to the support, a substantially flat first disc comprising a plurality of processing heads arranged on the flat side of the first disc facing away from the drive motor and arranged to process the hard surfacing, a substantially flat second disc coupled via vibration-damping coupling elements to the first disc and extending parallel to the first disc, a substantially flat third disc coupled via one or more additional coupling elements to the second disc and extending parallel to the second disc. The substantially flat second disc is coupled to the drive shaft of the drive motor such that the first, second and third discs form a stack of discs that is rotatable relative to the support. The additional coupling elements are deformation-reducing coupling elements configured to provide a deformation-reducing coupling between the second and the third disc.

In this way, the first, second, third disc and the coupling elements in between these discs form a stack of discs with increased stiffness. Owing to the deformation-reducing coupling elements, a high rigidity of the stack of discs and thus a high degree of flatness can be preserved during the actual processing of the surfacing itself, when great forces are exerted on the discs. The high degree of stiffness of the stack of discs in combination with the flatness of the discs has the result that, when the processing device reaches a relatively large and/or firm bump in the surfacing, almost the whole weight of the processing device will press onto the bump and evening out of this bump is realized extremely effectively and quickly.

According to another embodiment, the deformation-reducing coupling elements are arranged between the second and third discs at positions which are substantially uniformly distributed over the third disc. In this way the deformation-reducing coupling elements can reduce deformation of the second disc over substantially the whole surfacing of the second disc.

According to another embodiment, the deformation-reducing coupling elements are arranged in substantially radial direction relative to the center of the third disc. In this way the stack of discs can have an increased rigidity to reduce deformations in radial direction.

According to another embodiment, the deformation-reducing coupling elements extend each along a longitudinal direction and are arranged from the center of the third disc towards the periphery of the third disc in a star arrangement. In this way, the stack of discs can have an increased rigidity regularly spread over the surfaces of the second and third discs.

According to another embodiment, deformation-reducing coupling elements are elongated elements made of steel or similarly rigid material. In particular, the deformation-reducing coupling elements are tube-shaped. More particularly, the deformation-reducing coupling elements can have a constant rectangular cross-section in the longitudinal direction. In this way, a rigid coupling along the length of a coupling element can be realised, the fixing on each side of a rectangular cross section can be realized in a practical manner, while the second discs and third can be easily arranged in parallel to each other.

According to another embodiment, the deformation-reducing coupling elements and the vibration-damping coupling elements are located at corresponding positions on opposite sides of the second disc. In this way, the deformation forces transmitted from the first disc to the second disc via the vibration-damping elements can be counteracted by the additional rigidity of the deformation-reducing elements.

More in particular, a deformation-reducing coupling element is welded or mounted with a first mounting element on one of the second or the third disc and is mounted with a second mounting element on the other one of the second disc or third disc on a second, opposite side. In this way, a simple mechanical rigid coupling between the second and the third disc can be realized.

According to another embodiment, the device further comprises a second rotary processing unit, and the drive motors are configured to rotate the stack of discs of the first processing unit in a first rotational direction and rotate the stack of discs of the second processing unit in a second rotational direction, opposite to the first rotational direction. In this way, the diameters of the discs in a stack for a configuration with two processing units can be reduced compared to a configuration with a single processing unit while processing the same area of a surfacing. Accordingly, the power provided to rotate such smaller discs can be reduced, such that the deformation forces on the stacks of discs can also be reduced. In this way, the flatness and rigidity of the stack of discs of a dual processing unit device can be increased, increasing, as a consequence, the accuracy of the processing and the lifespan of the device, less susceptible to wear.

According to another embodiment, the support further comprises a support drive motor with a support drive shaft for rotating the support relative to the frame, and a power dividing element providing power to the support drive motor and the drive motor of each rotary processing unit. In this way, the frame carrying the processing units can rotate around the shaft of the support motor drive, to even the processing of the surfacing on a larger area defined by the rotation of the support.

According to another embodiment, the drive motor of the first processing unit, the drive motor of the second processing units and the support drive motor are hydraulic motor powered from one common hydraulic source. In this way, a common hydraulic source may power all the motor drives of the device. In particular, a common hydraulic source can be arranged on the vehicle on which the device is mounted.

According to another embodiment, the power dividing element is a manifold element, such as a hydraulic manifold element. This power dividing element is thus able to transmit the hydraulic power between two elements rotating one with respect to the other.

According to another embodiment, the support is configured to rotate 360 degrees (clockwise and/or anti-clockwise) relative to the frame around the support drive shaft of the support drive motor. This brings that within a rotation of the support drive motor, an area under the support can be evened out by each processing unit successively. In particular, in case of processing a surfacing with a partially irregular surface, the wear of the two processing units can be averaged.

According to another embodiment, the motor drive of each rotary processing unit is mounted for pivoting with respect to the support. In this way, the two processing units may follow a change in elevation of the surface of the surfacing.

According to another embodiment, the processing heads are configured for performing any of the following processing: hammering, milling, grinding or polishing. The same principle may be applied whether the processing heads are chisels or steel protrusions like hammer wheels or any other suitable type of processing heads by rotation.

According to another embodiment, the three discs are substantially circular, and wherein the central point of the first disc substantially corresponds to the central of the second disc, and to the central point of the third disc. In this way a rigid stack of discs can be realized. In particular, the diameter of the third disc is substantially identical to the diameter of the second disc. In this way, the deforming forces on the second disc can be compensated by the rigidity of third disc to which it is coupled. More particularly, the first and/or the second and/or the third disc are manufactured substantially from metal. Alternatively, the discs are manufactured from a material having a rigidity substantially equal to the rigidity of steel.

According to another embodiment, the surfacing is a paved surface and/or the surfacing is formed by stone, concrete or asphalt, such as a road surfacing manufactured from stone, concrete or asphalt.

According to another embodiment, the frame comprises a pivoting unit such that when the frame is mounted to a vehicle, the frame and the pivoting unit fixed thereupon are arranged for pivoting relative to the vehicle in at least the upward and downward direction.

According to another aspect of the disclosure, a vehicle is provided to which a device as described in the previous embodiments is releasably mounted, wherein the device is optionally arranged on the vehicle for pivoting in at least the upward and downward direction.

According to another aspect of the disclosure, a method for processing a hard surfacing with a vehicle as claimed in the previous embodiments is provided. The method comprises the steps of placing the at least one rotary processing unit on the surfacing, translating the at least one rotary processing unit over the surfacing with the vehicle and simultaneously rotating the at least one rotary processing unit with the associated drive motor for the purpose of processing the surfacing, particularly flattening the surfacing. In this way, a large surface can be processed efficiently.

According to another embodiment, the method further comprises the steps of rotating the support with respect to the frame while carrying the rotating processing units. It is possible to use three or more processing units.

Further advantages and features and details of the disclosure will be elucidated on the basis of the following description thereof.

BRIEF DESCRIPTION OF THE FIGURES

The above, as well as additional, features will be better understood through the following illustrative and non-limiting detailed description of example embodiments, with reference to the appended drawings.

Reference is made in the description to the following figures.

All the figures are schematic, not necessarily to scale, and generally only show parts which are necessary to elucidate example embodiments, wherein other parts may be omitted or merely suggested.

DETAILED DESCRIPTION

Example embodiments will now be described more fully hereinafter with reference to the accompanying drawings. That which is encompassed by the claims may, however, be embodied in many different forms and should not be construed as limited to the embodiments set forth herein; rather, these embodiments are provided by way of example. Furthermore, like numbers refer to the same or similar elements or components throughout.

Several embodiments of a vehicle provided with a device according to the disclosure and of the method for processing the surfacing are given herein below. The surfacing can further be a paved surface. The surfacing is for instance formed by stone, concrete or asphalt, particularly by a road surface manufactured from stone, concrete or asphalt.

Figure 1:
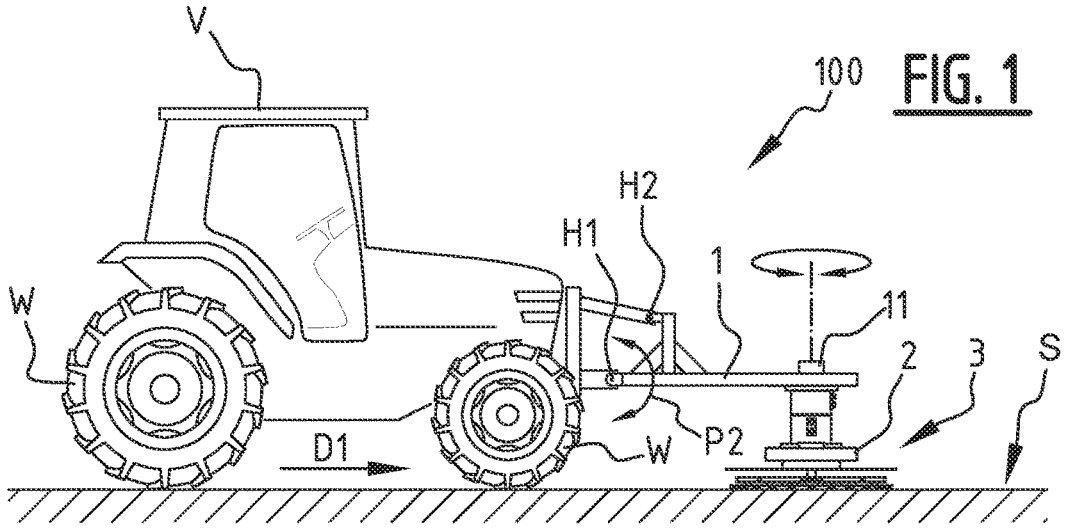
FIG. 1 is a schematic view of a vehicle provided with the embodiment of a device according to the disclosure.

FIG. 1 shows a vehicle (V), for instance a self-propelling vehicle on four wheels (W) which is driven using a combustion engine to drive over a surfacing S (direction of travel $D_1$). The vehicle (V) is steered by a driver or operating person (BP, not shown). The vehicle further comprises a power supply (not shown), for instance a hydraulic power supply, for the drive motor of a rotary processing unit 3 to be described herein below. The vehicle V further comprises a power supply (not shown) for powering lifting means whereby the rotary processing unit 3 can be lifted or can be lowered, for instance in the form of a hydraulic, pneumatic or electric lifting cylinder.

Mounted on the front side of the vehicle is a device 100 according to an embodiment of the disclosure. The device 100 comprises inter alia a frame 1 to be mounted to a vehicle V, a support 2 coupled to the frame 1 for carrying at least a first rotary processing unit 3 arranged to process the hard surfacing S. The rotary processing unit 3 is adapted for processing the hard surfacing under it. Frame 1 is arranged for pivoting on the front side of the vehicle using hinges H1 of a first pivoting unit so that the frame is able to pivot upward (to a transport position) and pivot downward (to a position of use, see for instance, FIG. 1, pivoting directions $P_1$). Frame 1 is arranged on the opposite outer end with a support motor drive 11 with a drive shaft, for rotating the support 2 relative to the frame 1. The support motor drive 11 enables the rotation of the support 2 around an imaginary axis extending from the drive shaft of the support motor drive 11 and perpendicularly to the direction of travel. The frame 1 with the support 2, the drive motor 11 and the processing unit 3 mounted thereon can be pivoted upward or downward (direction $P_1$) with the above stated lifting means in the form of a lifting cylinder. One outer end of lifting cylinder is mounted pivotally on (a frame of) the vehicle itself with a hinge, while on the opposite outer end another hinge H2 provides for a pivoting connection to the pivotable frame 1. The lifting cylinder is for instance a hydraulic lifting cylinder which can be controlled via the hydraulics of the vehicle itself. The operating person in the vehicle can turn the frame 1 in upward and downward direction ($P_1$) using the lifting cylinder.

Figure 2:
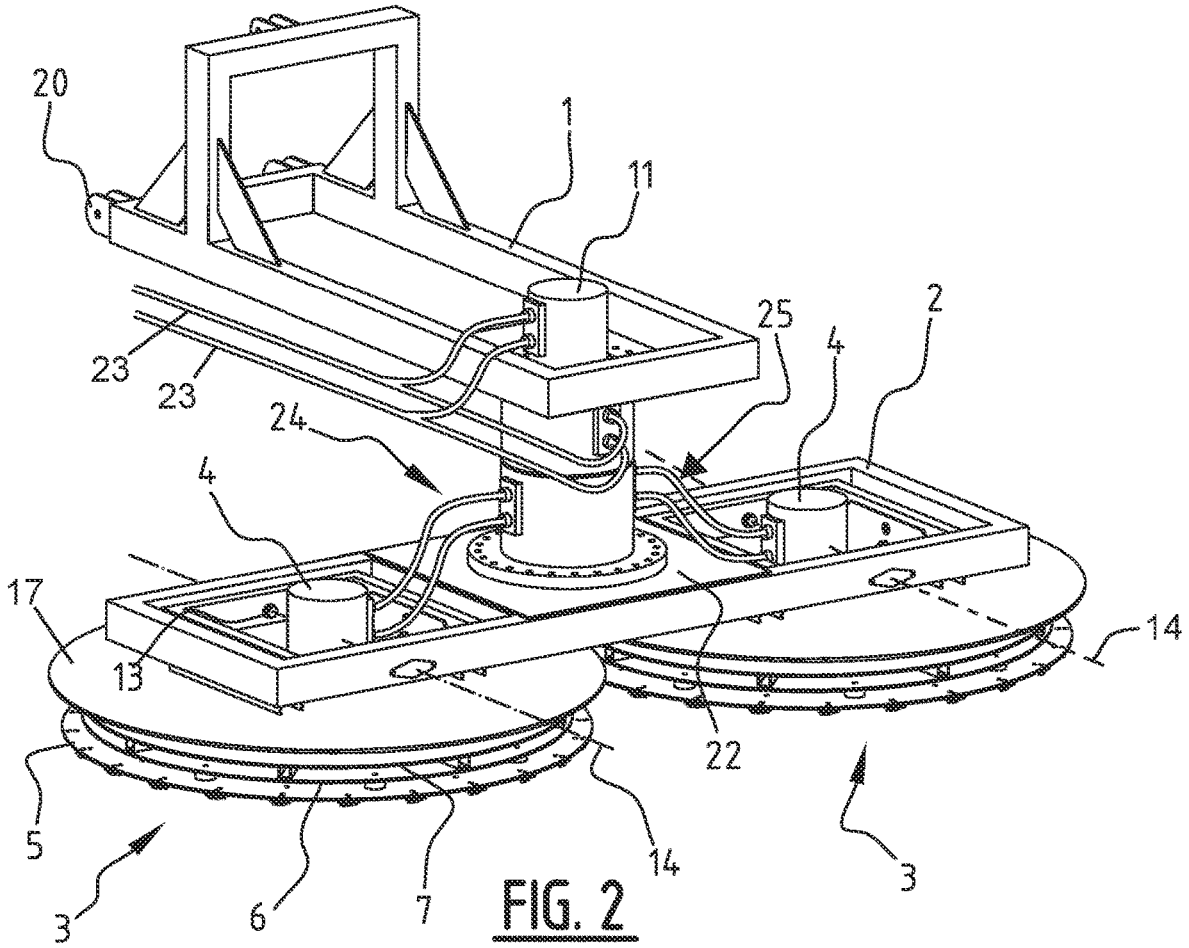
FIG. 2 is a schematic perspective view of a device according to the disclosure.
Figure 3:
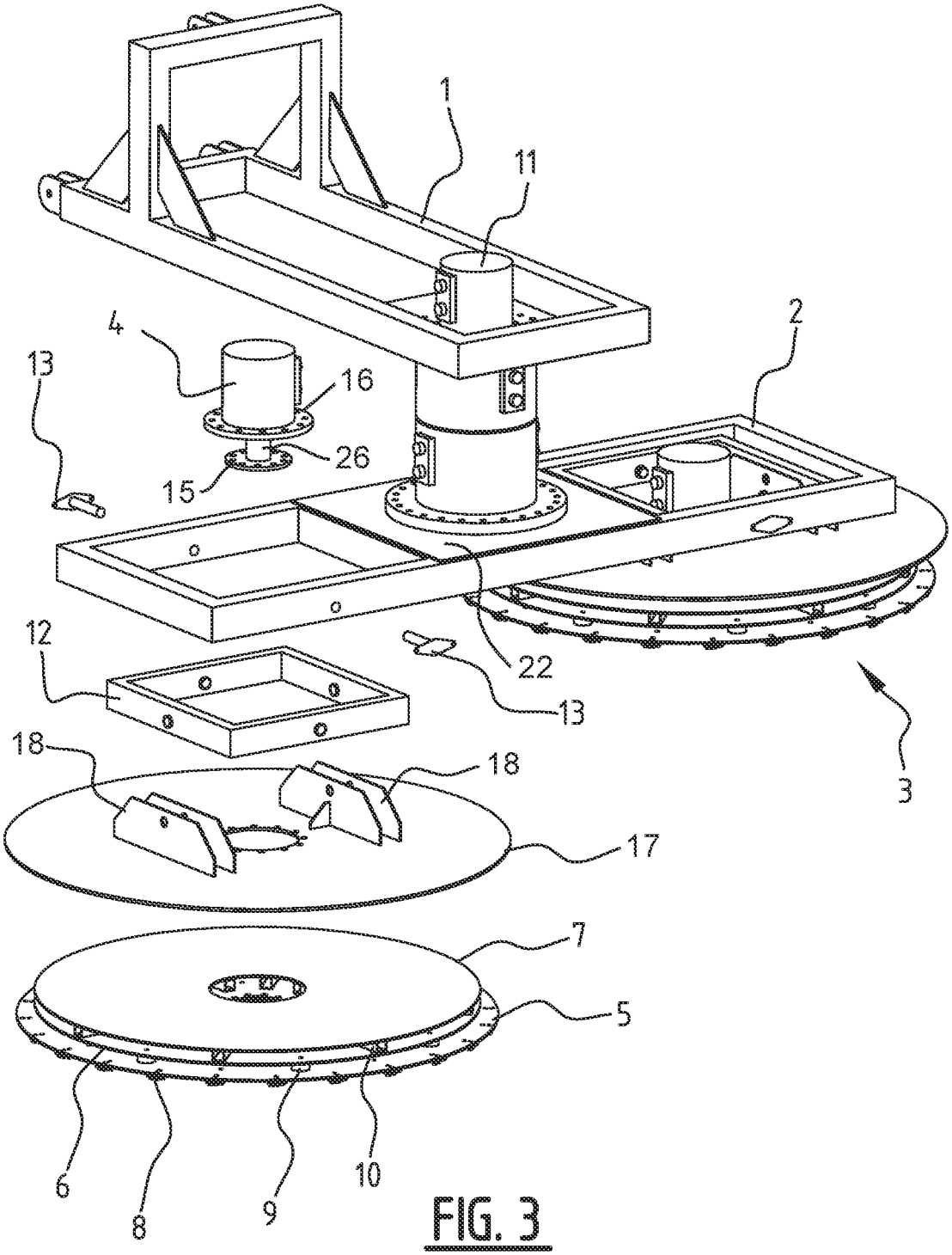
FIG. 3 is a partially exploded view from above of the embodiment of FIG. 2, in which one processing unit has been represented in an exploded view.
Figure 4:
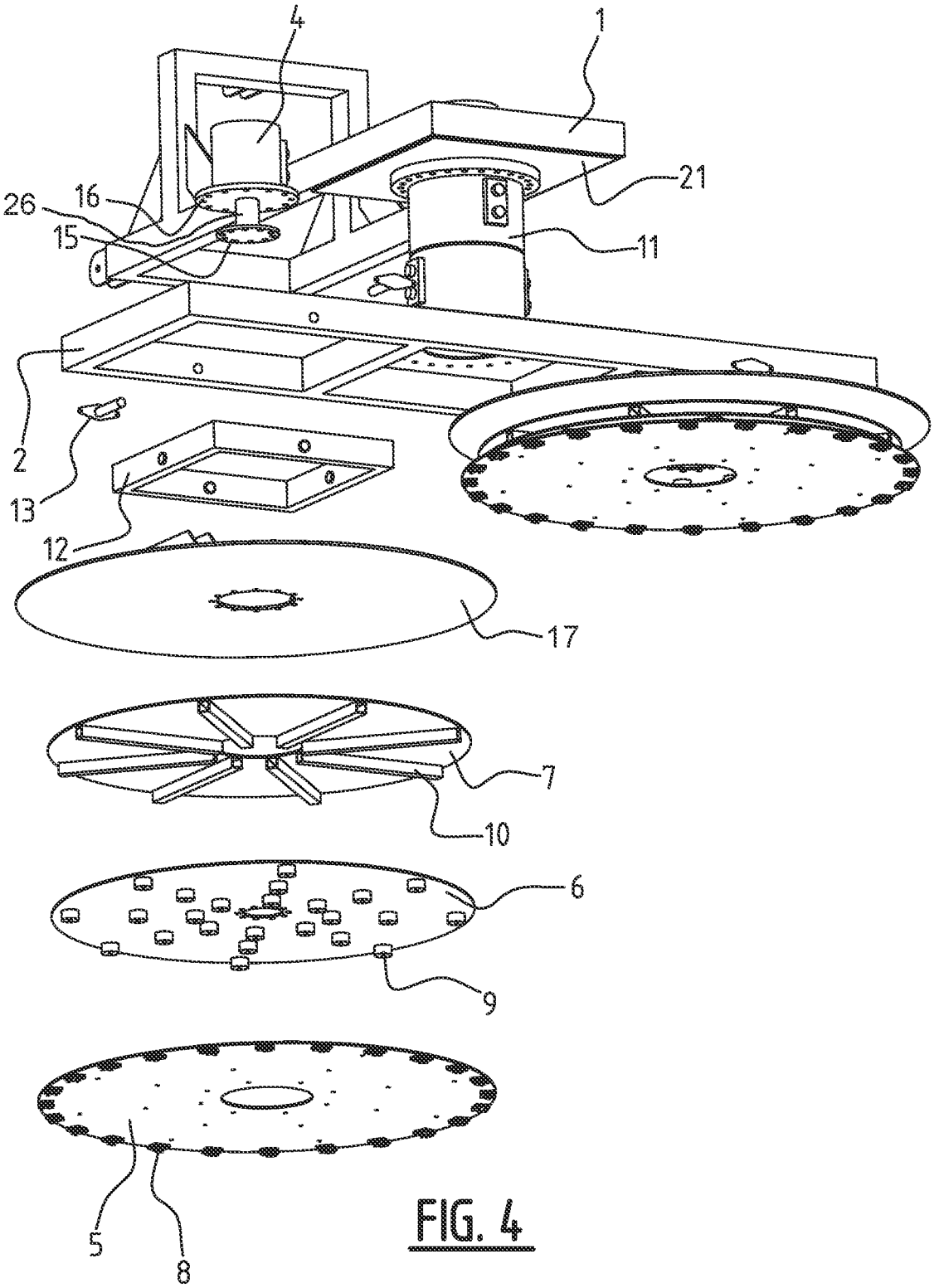
FIG. 4 is a partially exploded view from below of the embodiment of FIG. 2, in which one processing unit has been represented in an exploded view.

In the embodiment shown in FIGS. 2 to 4, the frame 1 is formed as a rectangular frame with a U-shaped perpendicular extension for interacting with the hinges H2. On one end of the frame are arranged coupling means 20 for coupling the support 2 via the hinges H1 to the vehicle. On the opposite end of the frame, arranged inside the frame 1 is a mounting plate 21 of a support drive motor 11. The support drive motor 11 is mounted fixedly on the frame 1.

The support 2 is coupled to the drive shaft of the support drive motor 11 and is thus rotatable with respect to the frame 1. The support 2 carries two rotary processing units 3, each rotary processing unit 3 being adapted for processing the hard surfacing S under it. Each rotary processing unit 3 comprises inter alia a drive motor 4, and three substantially flat discs 5-7. One of the discs, the lowest first one, comprises a plurality of processing heads arranged on the flat side of the first disc facing away from the drive motor 4 and arranged to process the hard surfacing S.

In the embodiment of FIG. 2, the support 2 is formed as a rectangular frame, comprising in its middle part, arranged inside the support 2, a mounting plate 22 for coupling with the drive shaft of the support drive motor 11. An imaginary axis extending from the drive shaft of the support drive motor 11 passes through the center of gravity of the support 2. On either side of this mounting plate 22 are arranged pivoting frames 12 pivotably connected to the support 2. Each pivoting frame 12 is arranged at a distance and inside the support 2 and can pivot around pivot elements or pivot points 13 defining an imaginary pivoting axis 14. The pivoting axes 14 of the pivoting frames 12 of the first and second processing units 3 mounted on the support 2 are parallel with each other and perpendicular to the longitudinal direction of the support 2.

Each drive motor 4 is provided with a drive shaft 26, for rotating its respective rotary processing unit 3 relative to the support 2 around an imaginary axis extending from its drive shaft. A substantially flat first disc 5 comprises a plurality of processing heads 8 arranged on the flat side of the first disc 5 facing the surfacing S. The processing heads 8 are facing away from the drive motor 4 and arranged to process the hard surfacing S. A substantially flat second disc 6 is coupled via vibration-damping coupling elements 9 to the first disc 5 and extends parallel to the first disc 5. A substantially flat third disc 7 is coupled via one or more additional coupling elements 10 to the second disc 6 and extends parallel to the second disc 6. The additional coupling elements 10 are deformation-reducing coupling elements configured to provide a deformation-reducing coupling between the second disc 6 and the third disc 7.

The substantially flat second disc 6 of a processing unit 3 is coupled to a mounting flange 15 of the drive shaft 26 of the drive motor 4 of that processing unit 3 such that the first disc 5, the second disc 6 and the third discs 7 form a stack of discs that is rotatable relative to the support 2 around the drive shaft 26 of the drive motor 4 of that processing unit 3. Each drive motor 4 of a rotary processing unit 3 is thus configured to rotate the first, the second and the third disc of its associated rotary processing unit 3 as one whole. It is noted that the first and/or the second and/or the third disc may be manufactured substantially from metal.

The central point of the first disc 5 substantially corresponds to the central point of the second disc 6, and to the central point of the third disc 7. The drive shaft 26 of a drive motor 4 is attached using the mounting flange 15 and a number of fastening means (screws) to the second disc 6, while a housing or drive motor body 16 of the drive motor 4 is attached to a support plate 17 extending essentially parallel to discs 5-7, for instance using a number of fastening means such as screws. More specifically, the drive motor body 1 of the drive motor 4 is pivotably attached to a pair of upward flanges 18 arrange sideways of the central opening in the support plate 1 enabling the support plate to pivot along a respective imaginary further pivot axis extending perpendicular to the earlier-mentioned pivot axis 14. Driving (rotation) of drive shaft relative to the (stationary) drive motor body 16 entails a corresponding rotation of the stack of discs 5-7 coupled together and mounted fixedly thereon.

In order to ensure that the stack of discs 5-7 form a stiff and substantially inflexible whole, the discs 5-7 are coupled to each other using a large number of coupling elements 9 and 10. Coupling elements 9 are shown in FIG. 4 as vibration-damping coupling elements. These vibration-damping coupling elements damp possible vibrations in the second disc 6 despite the mounting of the second disc 6 on the first disc 5.

In the shown embodiment, the coupling elements 9 are formed by a number of solid, cylindrical blocks of elastic material, for instance rubber or the like. These blocks are mounted on the first disc 5 using screws and on the second disc 6 using screws. The screws which are arranged in one disc do not make contact with the screws 19 arranged in the other disc. A high degree of damping of the vibration from lower disc 5 to upper disc 6 can be achieved by not allowing the plates and the fastening screws to come into contact with each other but to have the only contact between the two discs take place via the vibration-damping blocks.

In the shown embodiment, the coupling elements 9 are arranged between the first and second discs at positions which are substantially uniformly distributed over the second disc. In particular, the coupling elements 9 are arranged in lines extending radially from the center of the disc to its periphery and, the lines being regularly disposed every 45 degrees. The coupling elements 9 are thus distributed substantially symmetrically around the central point of the first and second disc. In the shown embodiment, six coupling elements are used per diameter (so a total of 12 coupling elements) to couple the two discs to each other. In other embodiments, this number can be smaller or greater.

In the shown embodiment, the additional coupling elements 10 take the form of deformation reducing elements. The deformation-reducing coupling elements 10 are for instance tube-shaped, have a rectangular cross section. The deformation-reducing coupling elements 10 comprises for example an elongated element made of steel or similarly rigid material. The deformation-reducing coupling elements 10 lie directly against the underside of the third disc 7 and the upper side of second disc 6. The deformation-reducing coupling elements 10 may be welded or mounted with a first mounting element on one of the second or the third disc 6 and 7 and may be mounted with a second mounting element on the other one of the second disc or third disc 6 and 7 on a second, opposite side.

In the shown embodiment, the deformation-reducing coupling elements 10 are arranged in a substantially radial direction relative to the center of the third disc 7 and regularly disposed every 45 degrees in a star arrangement. The deformation-reducing coupling elements 10 are thus distributed substantially symmetrically around the central point of the discs 5 to 7. In the shown embodiment, eight coupling elements 10 are used to couple the two discs 6 and 7 to each other. In other embodiments, this number can be smaller or greater. The deformation-reducing coupling elements 10 are arranged between the second and third discs 6 and 7 at positions which are substantially uniformly distributed over the third disc 7.

Further in an embodiment of the disclosure, the deformation-reducing coupling elements 10 and the vibration-damping coupling elements 9 are located at corresponding positions on opposite sides of the second disc 6.

The processing heads 8 arranged on the first disc are moved over the surfacing by the motor drive 4 to process the surfacing. The processing heads 8 are configured for performing any of the following processing: hammering, milling, grinding or polishing. These processing heads may for instance be hammer wheel holders that can be rotated over the surfacing with relatively little friction force or chisels that can grind or polish the surfacing with relatively heavy friction force. The number of processing heads depends on the dimensions of the processing unit.

Further the device 100 comprises a power dividing element providing power to the support drive motor 11 and the drive motor 4 of each rotary processing unit 3. This power dividing element, also called a manifold, is combined with the support drive motor 11. The combined support manifold/motor drive 11 of FIG. 2 receives input hydraulic power via hydraulic inputs 23 from a hydraulic source located on the vehicle and rotates the support 2 with respect to the frame 1 using part of this received hydraulic power. At the same time, support drive motor 11 delivers, on its output side, i.e. on the side of the shaft of the motor drive, two hydraulic power outputs 24 and 25 for powering respectively the motor drives 4 of the two rotary processing units 3. In this way the drive motor 4 of the first processing unit 3, the drive motor 4 of the second processing unit 3 and the support drive motor 11 are hydraulic motor powered from one common hydraulic source.

During operation the support 2 can then rotate 360 degrees relative to the frame 1 around the support drive shaft of the support drive motor 11 while providing hydraulic power to the motor drives 4 of the rotary processing units 3.

Figure 5:
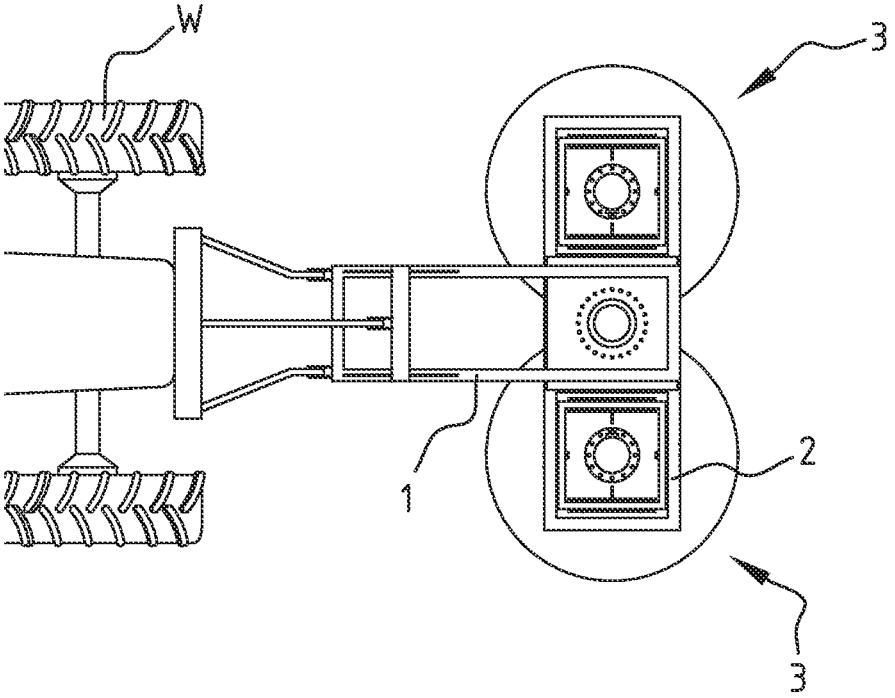
FIG. 5, FIG. 6, FIG. 7, FIG. 8, and FIG. 9 are schematic views from above of a device according to the disclosure in successive positions during one rotation cycle of the support motor drive when processing a surfacing.

FIG. 5 illustrates a method for processing a hard surfacing with a vehicle equipped with a device as described in FIGS.

2 to 4. The method comprises inter alias the steps of placing the two rotary processing units on the surfacing, and of translating the two rotary processing units over the surfacing with the vehicle while simultaneously rotating the rotary processing units with the associated drive motors for the purpose of processing the surfacing, particularly flattening the surfacing.

During operation the drive motors 4 are configured to rotate the stack of discs of the first processing unit 3 in a first rotational direction and rotate the stack of discs of the second processing unit 3 in a second rotational direction, opposite to the first rotational direction.

Figure 6:
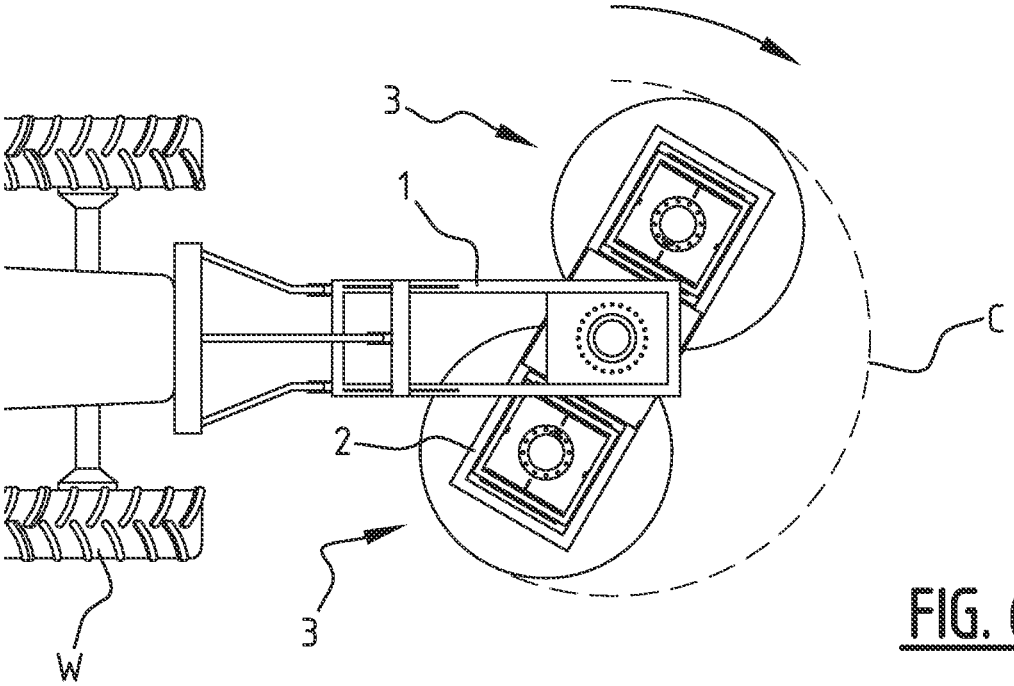
Figure 7:
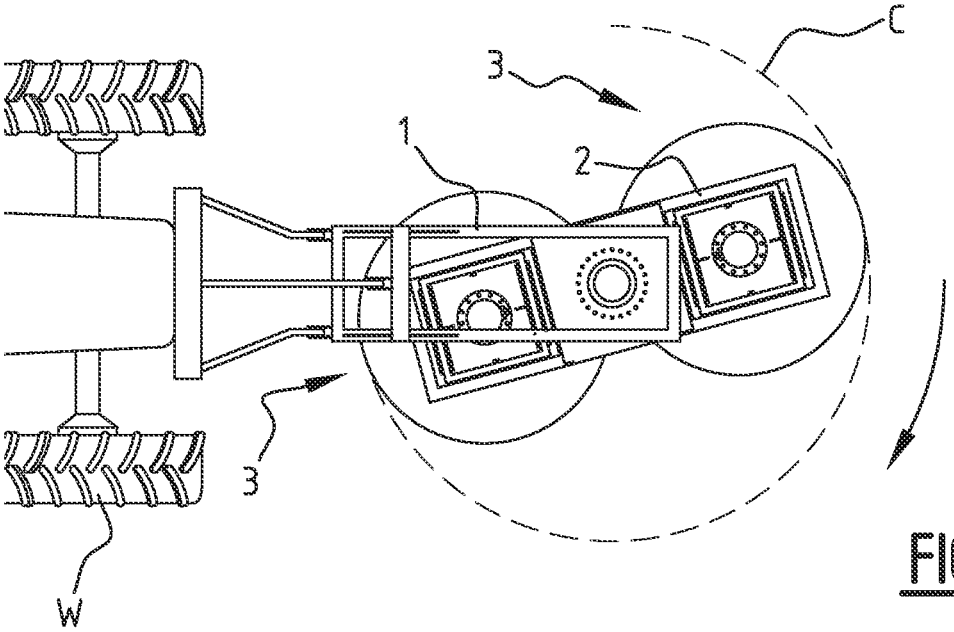
Figure 8:
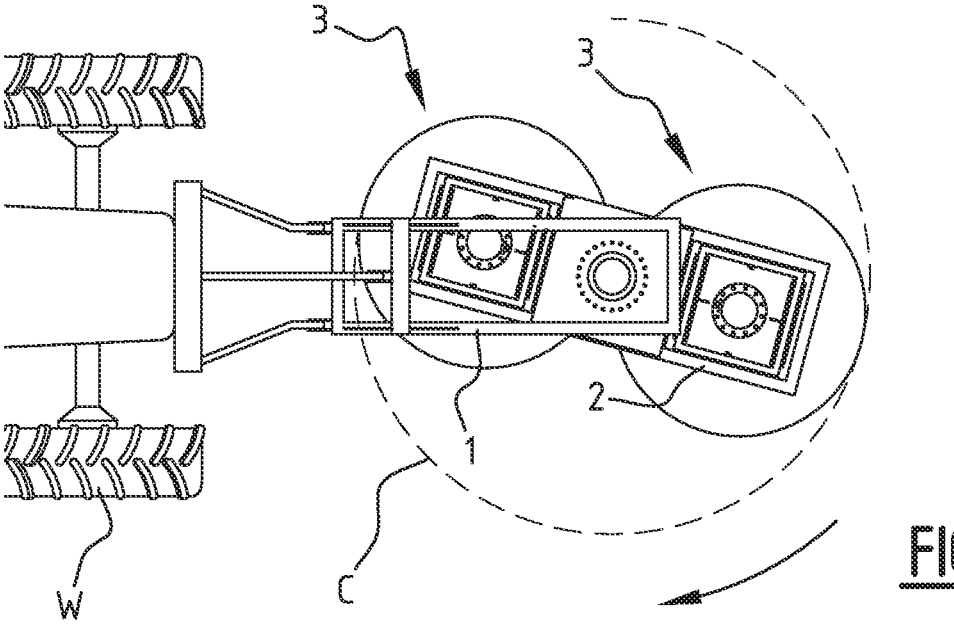
Figure 9:
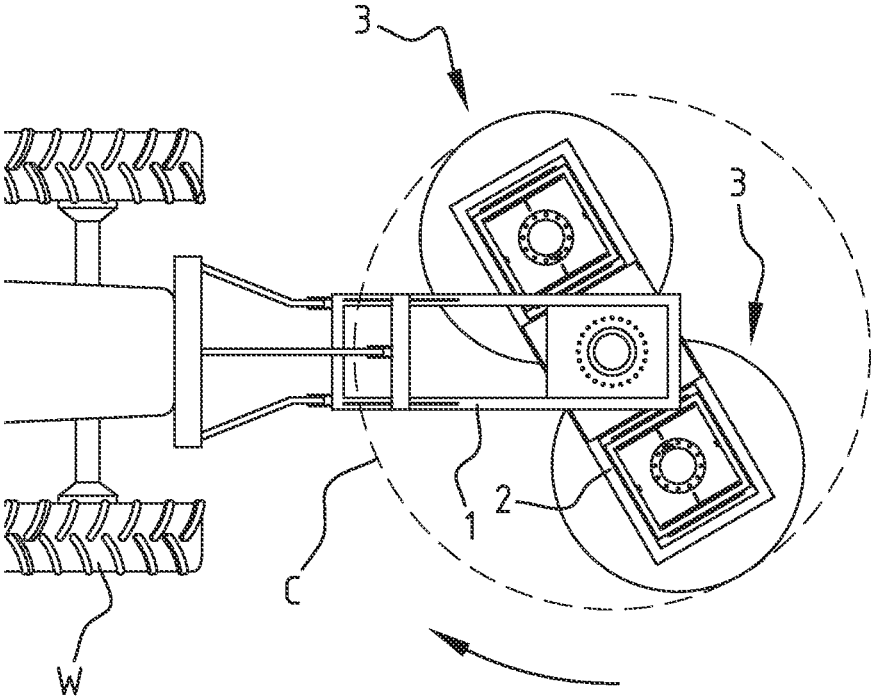

In a further embodiment, the method further comprises rotating the support with respect to the frame while carrying the rotating processing units as will be explained in FIGS. 6-9. FIGS. 6-8 show how from the rest position of FIG. 5 successive positions of the device during one rotation of the support motor drive. The processing units carried by the support 2 are then during operation rotated around the shaft of the support motor drive processing a circular surface C with the exception of a small central area in between the two processing units 3.

Figure 10:
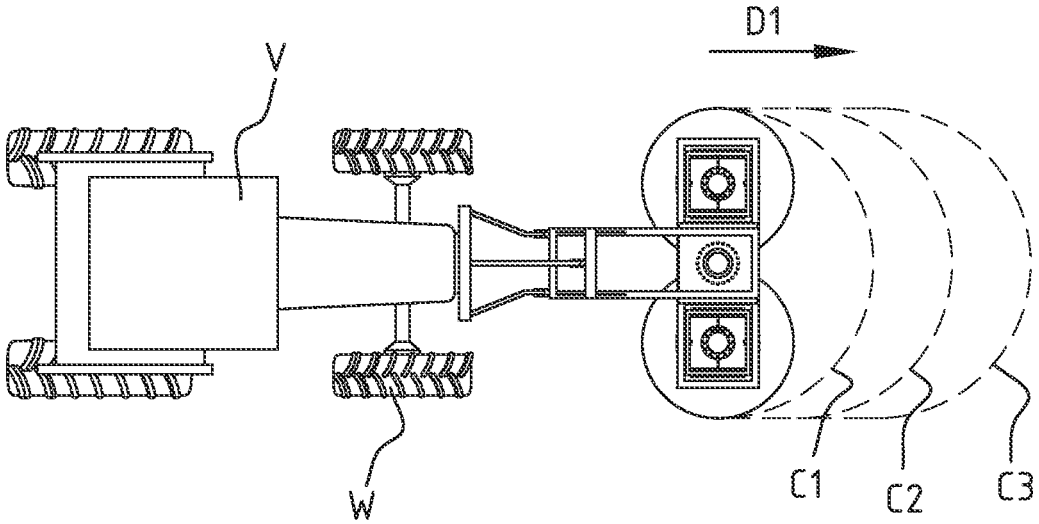
FIG. 10 is a schematic view from above of a device according to the disclosure showing the combination of the rotation of the motor drives of the first and second processing units, with the rotation of the support motor drive and with the translation of the vehicle.

FIG. 10 shows the combination of all the movements of the device on the surface during the translation of the vehicle V. In that case, the processing units 3 each respectively rotate around their own imaginary drive shaft axis, while the support 2 may also rotate around the imaginary axis of the drive shaft of the support motor drive 11 (as shown in FIGS. 6 to 9), but also the vehicle V may translate in a determined direction D1 with a speed of a walking pace or slightly slower (for instance 50 meters (m) per hour>speed>4000 m per hour (walking pace). In doing so, successive circular surfaces C1, C2, C3 of processed surfacing are formed, which overlap each other such that any area not processed during a rotation, at the center of a circular surface C, will be processed in at least one next circular surface. As the vehicle progresses over the surfacing, any bump will thus be evened out by successive passes of the rotary processing units 3. In this way, a relatively hard surfacing, such as a concrete slab or roadway asphalt, can be evened out quickly and effectively. Because the construction of the stack of discs using the additional coupling elements 10 is extremely stiff, it will be possible to realize an accurate evening out of the surfacing. Because the vibrations between the second and first plate 5 and 6 can further be absorbed by coupling elements 9, the chance of damage to the construction, particularly drive motors 4 thereof, is smaller.

According to embodiments of the disclosure, the device can be embodied for surface-tracking processing (flattening) of the surfacing. This is understood to mean that the processing unit preserves the rough variations (macro variations) in the height and/or the position of the upper surface of the surfacing (for example an incline in a road surface), but smooths out detail variations in the height and/or the position thereof (for instance connecting edges between adjoining concrete slabs of the road surface). The present disclosure is not limited to the embodiment thereof described herein. The rights sought are defined by the following claims, within the scope of which countless modifications can be envisaged.

While some embodiments have been illustrated and described in detail in the appended drawings and the foregoing description, such illustration and description are to be considered illustrative and not restrictive. Other variations to the disclosed embodiments can be understood and effected in practicing the claims, from a study of the drawings, the disclosure, and the appended claims. The mere fact that certain measures or features are recited in mutually different dependent claims does not indicate that a combination of these measures or features cannot be used. Any reference signs in the claims should not be construed as limiting the scope.

What is claimed is:

1. A device for processing a hard surfacing, the device comprising:
- a frame to be mounted to a vehicle:
- a support coupled to the frame, configured for carrying one or more rotary processing units, each rotary processing unit being adapted for processing the hard surfacing under the processing unit and wherein each rotary processing unit comprises:
  - a drive motor with a drive shaft, for rotating each rotary processing unit relative to the support;
  - a substantially flat first disc comprising a plurality of processing heads arranged on a flat side of the first disc facing away from the drive motor and arranged to process the hard surfacing;
  - a substantially flat second disc coupled via vibration-damping coupling elements to the first disc and extending parallel to the first disc; and
  - a substantially flat third disc coupled via one or more additional coupling elements to the second disc and extending parallel to the second disc; and
- wherein at least one of the second or third disc is coupled to the drive shaft of the drive motor such that the first, second and third discs form a stack of discs that is rotatable relative to the support, and
- wherein the additional coupling elements are deformation-reducing coupling elements configured to provide a deformation-reducing coupling between the second and the third disc.

2. The device of claim 1, wherein the deformation-reducing coupling elements are arranged between the second and third discs at positions which are substantially uniformly distributed over the third disc.

3. The device of claim 1, wherein the deformation-reducing coupling elements are arranged in substantially radial directions relative to a center of the third disc.

4. The device of claim 1, wherein the deformation-reducing coupling elements extend each along a longitudinal direction and are arranged from a center of the third disc towards a periphery of the third disc in a star arrangement.

5. The device of claim 1, wherein the deformation-reducing coupling elements are elongated elements made of steel.

6. The device of claim 1,
- wherein the deformation-reducing coupling elements are tube-shaped.

7. The device of claim 1, wherein the deformation-reducing coupling elements and the vibration-damping coupling elements are located at corresponding positions on opposite sides of the second disc.

8. The device of claim 1, wherein the deformation-reducing coupling elements are each respectively welded or mounted with a first mounting element on one of the second or the third disc and mounted with a second mounting element on the other one of the second disc or third disc on a second, opposite side.

9. The device of claim 1, wherein:
- the one or more rotary processing units include a first rotary processing unit and a second rotary processing unit, and
- the drive motors are configured to rotate a stack of discs of the first rotary processing unit in a first rotational direction and rotate a stack of discs of the second rotary processing unit in a second rotational direction, opposite to the first rotational direction.

10. The device of claim 1, wherein the support further comprises;

a support drive motor with a support drive shaft for rotating the support relative to the frame, and a power dividing element providing power to the support drive motor and the drive motor of each rotary processing unit.

11. The device of claim 10, wherein:

the one or more rotary processing units include a first rotary processing unit and a second rotary processing unit, a drive motor of the first rotary processing unit, a drive motor of the second rotary processing unit, and the support drive motor are hydraulic motors powered from one common hydraulic source.

12. The device of claim 10, wherein the power dividing element is a manifold element.

13. The device as claimed in claim 1, wherein the support is configured to rotate 360 degrees relative to the frame around a support drive shaft of a support drive motor.

14. The device of claim 1, wherein the processing heads are configured for performing any of the following processing: hammering, milling, grinding or polishing.

15. The device of claim 1, wherein the surfacing is a paved surface, and/or wherein the surfacing is formed by stone, concrete or asphalt.

16. The device of claim 1, wherein the first disc, the second disc, and the third disc are substantially circular, and wherein a central point of the first disc substantially corresponds to a central point of the second disc, and to a central point of the third disc.

17. The device of claim 1, wherein a diameter of the third disc is substantially identical to a diameter of the second disc, and/or wherein the first and/or the second and/or the third disc are manufactured substantially from metal.

18. The device of claim 1, wherein the frame comprises a pivoting unit such that when the frame is mounted to a vehicle, the frame and the pivoting unit fixed thereupon are arranged for pivoting relative to the vehicle in at least upward and downward directions.

19. The device of claim 1, wherein the drive motor of each rotary processing unit is mounted for pivoting with respect to the support.

20. A vehicle to which a device as claimed in claim 1 is releasably mounted, wherein the device is arranged on the vehicle for pivoting in at least upward and downward directions.

21. A method for processing a hard surfacing with a vehicle as claimed in claim 20, the method comprising:

placing the one or more rotary processing units on the surfacing, and translating the one or more rotary processing units over the surfacing with the vehicle and simultaneously rotating the one or more rotary processing units with the associated drive motor for processing the surfacing.

22. The method of claim 21, further comprising:

rotating the support with respect to the frame while carrying the one or more rotary processing units.

* * * * *